United States Patent [19]

Mills

[11] 4,338,593

[45] Jul. 6, 1982

[54] RODENT CONTROL APPARATUS AND METHOD

[75] Inventor: Thomas Mills, Chicago, Ill.

[73] Assignee: Sound Control, Inc., Algonquin, Ill.

[21] Appl. No.: 179,268

[22] Filed: Aug. 18, 1980

[51] Int. Cl.[3] ..... G08B 3/10

[52] U.S. Cl. ..... 340/384 E; 340/384 R

[58] Field of Search ..... 340/384 R, 384 E

[56] References Cited

U.S. PATENT DOCUMENTS

| | | | |
|---|---|---|---|
| 3,594,786 | 7/1971 | Brunner et al. | 340/384 E |
| 3,636,559 | 1/1972 | Del Grande et al. | 340/384 E |
| 3,838,418 | 9/1974 | Brown | 340/384 E |
| 3,872,472 | 3/1975 | Moschgat | 340/384 E |
| 3,873,960 | 3/1975 | Gates, Sr. | 340/384 E |
| 3,893,106 | 7/1975 | Schulein | 340/384 E |
| 4,001,817 | 1/1977 | Squires | 340/384 E |
| 4,186,387 | 1/1980 | Moschgat | 340/384 E |

*Primary Examiner*—John W. Caldwell, Sr.
*Assistant Examiner*—Daniel Myer
*Attorney, Agent, or Firm*—Silverman, Cass & Singer, Ltd.

[57] ABSTRACT

Apparatus and method for producing ultrasonic sound waves used to disperse rodents including negative feedback damping of a tuned band-pass filter output circuit. An electrical signal is frequency modulated, amplitude modulated asynchronously with the frequency modulation, pulsed on and off and applied to a speaker to produce ultrasonic sound waves corresponding thereto. The output signal is passed through a tuned band-pass filter circuit which includes negative feedback damping to reduce the power consumption of the amplification of the output signal and in part to produce the band-pass characteristics of the band-pass filter output circuit.

10 Claims, 10 Drawing Figures

RODENT CONTROL APPARATUS AND METHOD

FIELD AND BACKGROUND OF THE INVENTION

This invention relates generally to an apparatus and method for rodent control and in particular it relates to apparatus and method using ultrasonic sound waves to repel or disperse rodents such as rats and mice.

The dispersion of rodents by use of ultrasonic sound waves generally is performed by producing sound waves at frequencies of about from 15 to 30 KHz, frequency modulating the sound waves by sweeping them through the frequencies of this band and amplitude modulating the sound waves asynchronously with the frequency modulation of same. This provides ultrasonic energy at frequencies which the rodents are sensitive to with the randomization of the amplitude modulation preventing the rodents from adapting themselves to the ultrasonic energy.

Rodent control systems using such apparatus and methods generally are placed in areas of rodent infestation to drive, scatter or disperse the rodents from such areas. Such systems are required to be small in size and consume small amounts of electrical energy to produce the ultrasonic sound waves. Several such systems are known with an example of such system being that of that described in U.S. Pat. No. 3,636,559.

In U.S. Pat. No. 3,636,559 an ultrasonic sound signal is swept through a range of frequencies at which rodents are sensitive with an amplitude modulation of the ultrasonic sound waves occurring asynchronously with the frequency modulation. In addition, the sound waves are alternatively turned on and turned off to provide an interrupted output which permits the system speaker to cool off. In one embodiment of that patent, a plurality of speakers are provided which are sequentially operated to provide the ultrasonic sound levels so that one or more of the speakers may be cooling off while the others are operating. It should be noted that the system such as is disclosed in U.S. Pat. No. 3,636,559 operates with an ultrasonic sound level output by the speaker of about 100 decibels.

The power consumption required of such a system to produce the ultrasonic sound levels normally required to disperse the rodents may be reduced by providing negative feedback damping to a tuned band-pass filter output circuit of such a system. A reduced power consumption provides for smaller, less expensive system power supplies, smaller, more convenient packaging and less wasted heat which must be dissipated from the system.

SUMMARY OF THE INVENTION

In accordance with the apparatus and method of the invention there is provided an electrical circuit generating an electrical signal oscillating within an ultrasonic frequency band. This electrical signal is pulsed or turned on and off at regular intervals, is frequency modulated by causing the signal to be swept through the band of ultrasonic frequencies and is amplitude modulated by increasing the amplitude of the electrical signal by about twice its power for a predetermined period of time asynchronously with the frequency modulation of the electrical signal. The modulated electrical signal then is amplified and applied to a tuned band-pass filter with negative feedback damping being provided to reduce the power consumption of the amplifier and in part to provide the band-pass characteristics of the filter. The electrical signal output from the band-pass filter is applied to transducers such as speakers which produce sound waves in a band of about 18–30 KHz in response to the electrical signals applied thereto.

DESCRIPTION OF THE PREFERRED EMBODIMENT

The apparatus and method of the invention herein provide vibration of the atmosphere to repel or scatter rodents such as mice and rats. The vibrations of the atmosphere or sound waves are generated by way of an electrical signal through a transducer such as a speaker. The vibrations occur at a frequency which is above the normal hearing range for human beings but which has been shown to be well within the hearing range of such rodents.

Figure 1:
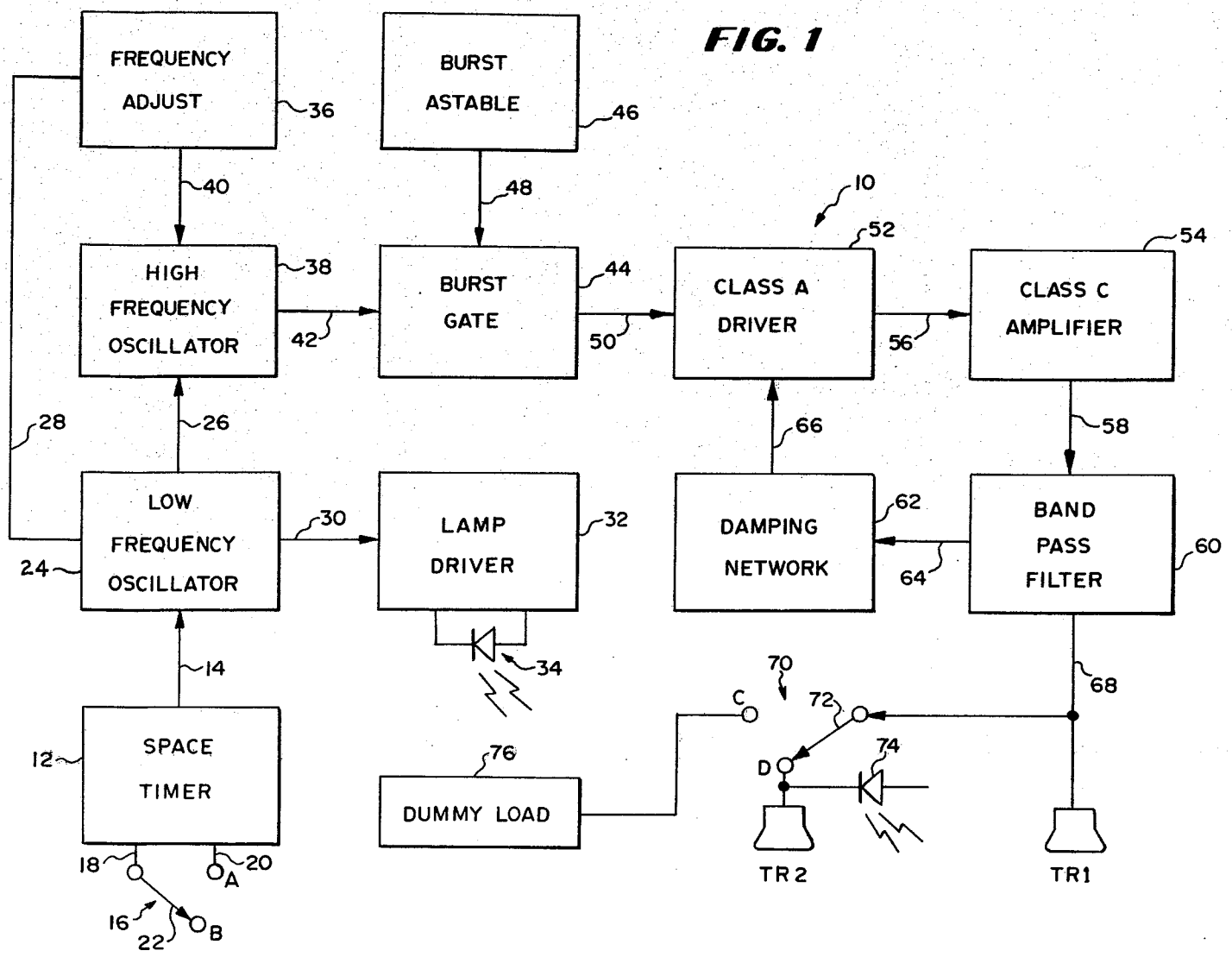
FIG. 1 is a block diagram of a circuit embodying the apparatus of the invention and using the method of the invention.

The apparatus and method of the invention may be best understood by referring to FIG. 1. The circuit of the apparatus of the invention is illustrated therein generally by the reference character 10. Circuit 10 includes space timer 12 which outputs a signal on lead 14 to control the on and off times of the sound waves. Switch 16 is coupled to space timer 12 by leads 18 and 20 so that when wiper 22 of switch 16 is in contact with the B terminal the sound waves are continuous and so that when the wiper 22 is in contact with the A terminal the sound waves are pulsed on and off.

Low frequency oscillator 24 receives the signal on lead 14 and provides a frequency modulated ramp signal on lead 26 and a mark space pedestal signal on lead 28. Low frequency oscillator 24 further provides a signal on lead 30 to lamp driver 32 which drives light emitting diode 34 to provide a visual indication that the mark space pedestal signal is operating.

Frequency adjust circuit 36 provides for manual adjustment of the frequency modulation of high frequency oscillator 38 through lead 40 by operating on the mark space pedestal signal of lead 28. Of course the main frequency modulation of the high frequency oscillator 38 occurs through the ramp signal on lead 26 with adjustment occurring by way of the signal on lead 40.

High frequency oscillator 38 provides an electrical signal which may oscillate in an ultrasonic frequency band. This electrical signal is frequency modulated by the ramp signal on lead 26 from about 18 to 30 KHz and is alternatively turned on and off in response to the mark space pedestal signal on lead 40. This frequency modulated and alternately turned on and off signal is output on lead 42 and is applied to a burst gate 44 which in response to a signal on lead 48 from burst astable circuit 46, amplitude modulates the signal from lead 42 by increasing the power of the signal on lead 42. This amplitude modulation occurs asynchronously relative to the frequency modulation of the signal on lead 42 with the amplitude modulated signal being output from burst gate 44 on lead 50.

The signal on lead 50 is amplified by class A driver 52 and class C amplifier 54 and is applied to tuned band-pass filter 60. Leads 56 and 58 respectively carry the signal from driver 52 and amplifier 54.

A portion of the signal from band-pass filter 60 is applied to damping network 62 by way of lead 64 and from damping network 62 back to class A driver 52 by way of lead 66. Damping network 62 is used in part to provide the desired frequency response of the band-pass filter 60 and a reduced power consumption of the amplification of the signal on lead 50.

The remainder of the output of band-pass filter 60 is provided on lead 68 to transducer TR1 and to wiper 72 of switch 70. Transducer TR1 may be such as a piezoelectric speaker to provide air vibrations of sound waves in response to an electrical signal applied thereto on lead 68. When wiper 72 is in contact with the D terminal of switch 70, transducer TR2 is energized with a visual indication of the electrical signal applied thereto occurring by way of light emitting diode 74. When wiper 72 is in contact with the C terminal of switch 70, the output signal on lead 68 is removed from transducer TR2 and is applied to a dummy load 76 to maintain the tuned characteristics of band-pass filter 60.

Thus, it may be seen that a high frequency oscillating signal is turned on and off at predetermined time intervals, is frequency modulated, and is amplitude modulated asynchronously with the frequency modulation to provide an electrical signal which drives transducers TR1 and TR2 to provide the desired sound waves. Feedback damping is provided in the amplification and band-pass filtering of the signal before it is output to provide the desired frequency response characteristics of the band-pass filter and reduce the power consumption of the amplification circuits.

Figure 2A:
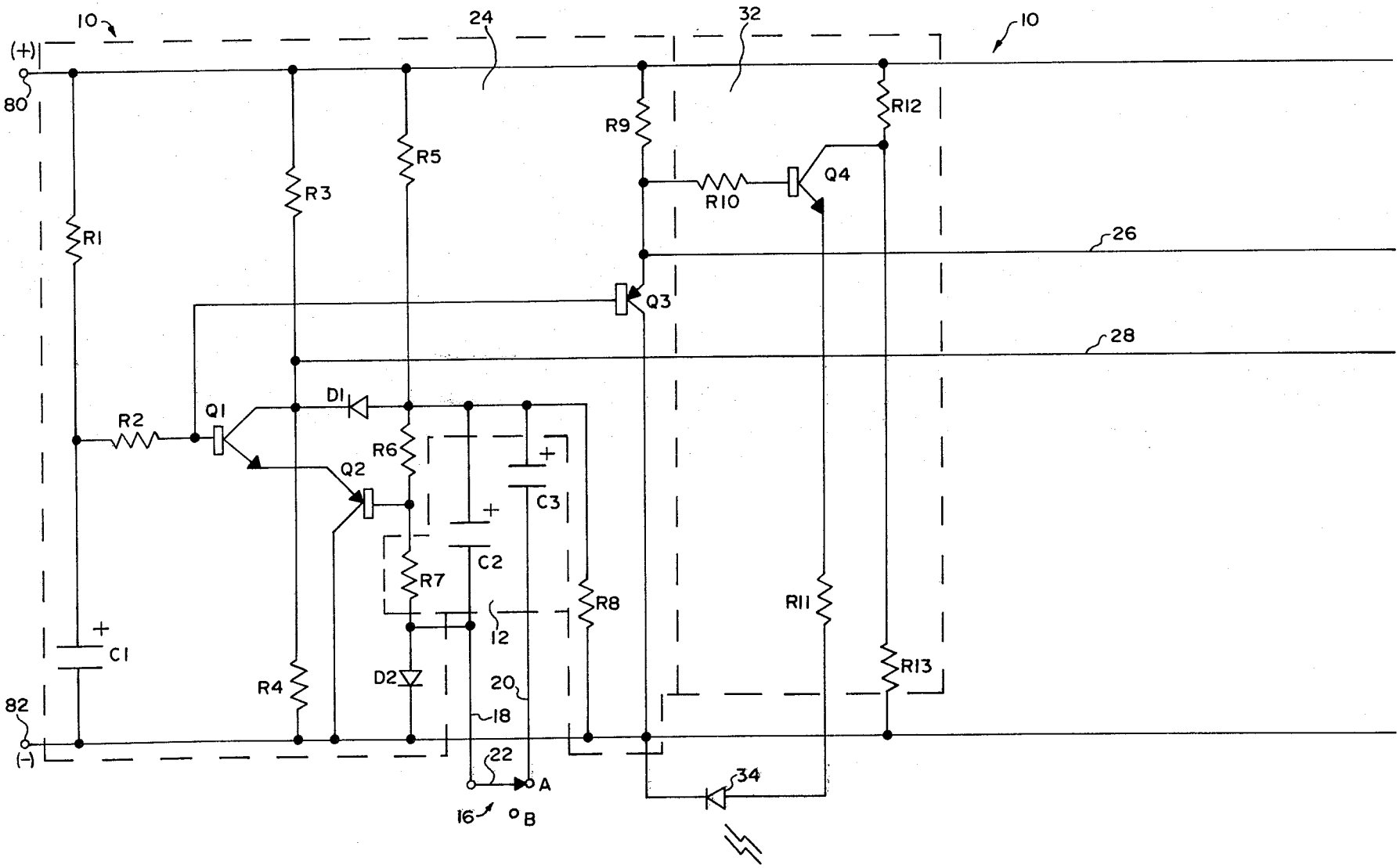
FIGS. 2(*a*), 2(*b*) and 2(*c*) are circuit diagrams of a first portion, a second portion and a third portion, respectively, of the circuit illustrated in FIG. 1.
Figure 2B:
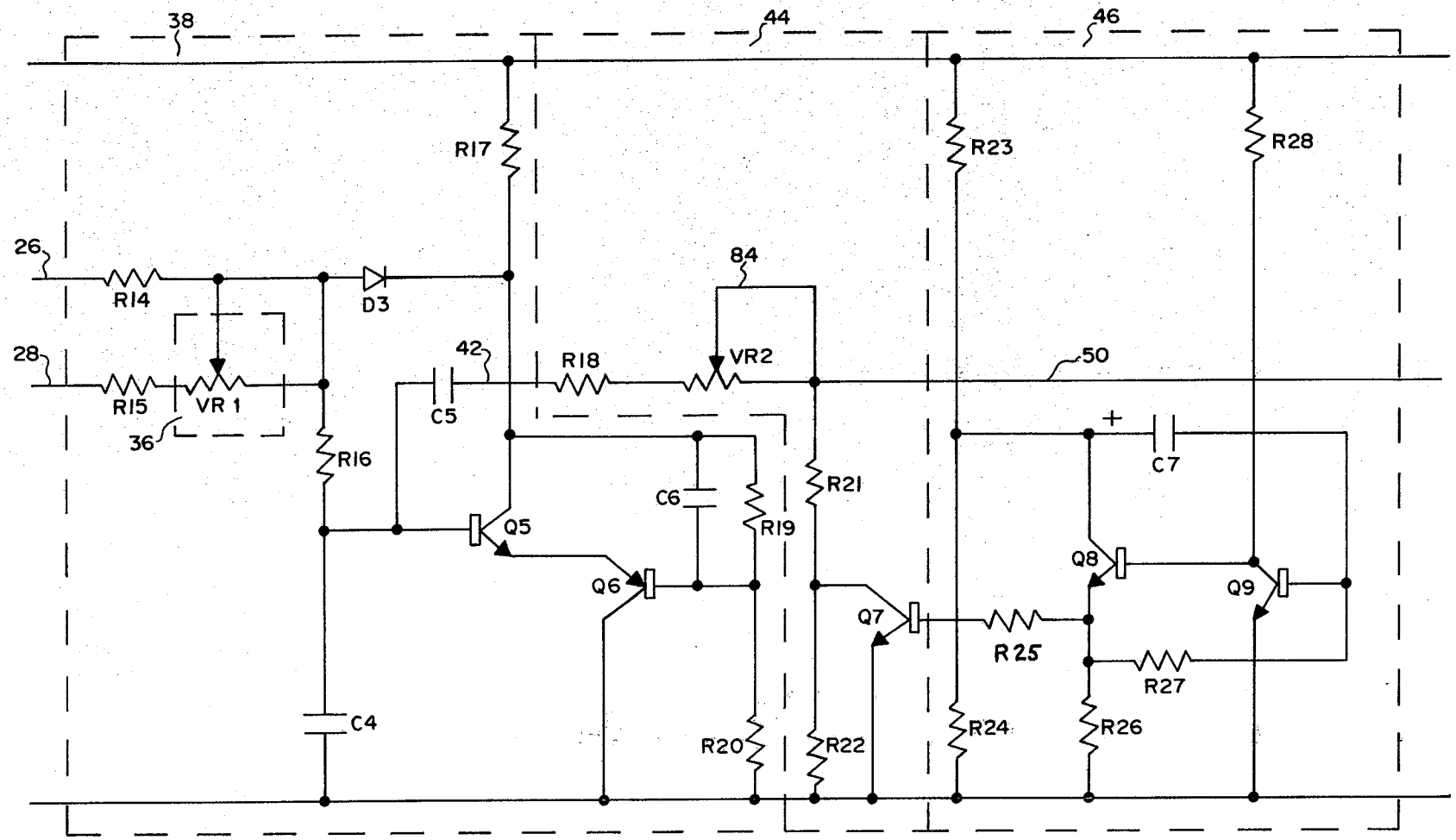
Figure 2C:
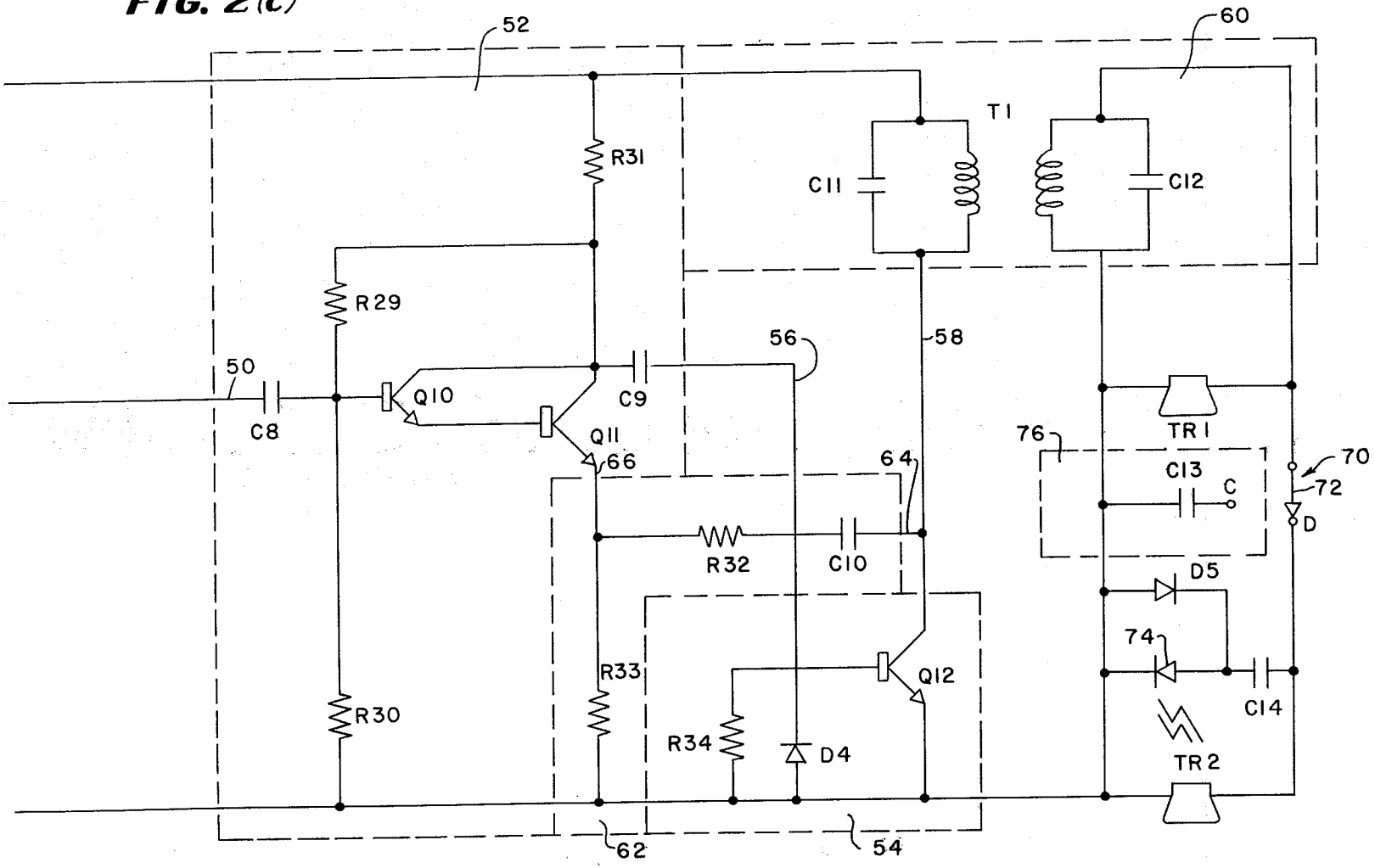
Figure 3A:
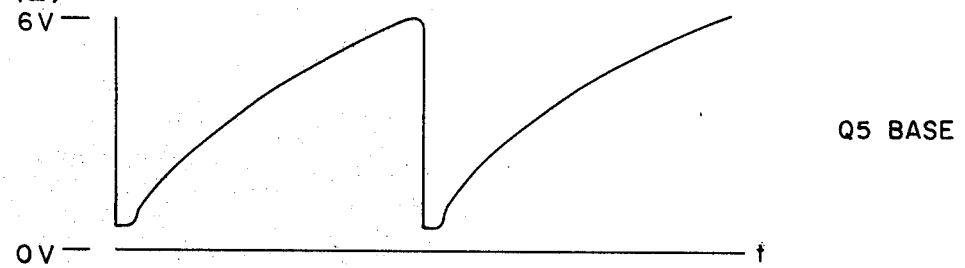
FIGS. 3(*a*)–(*e*) are graphs illustrating wave forms of the circuits described in FIGS. 2(*a*)–(*c*) at points of the circuit indicated.
Figure 3B:
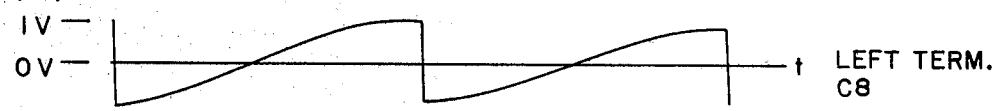
Figure 3C:
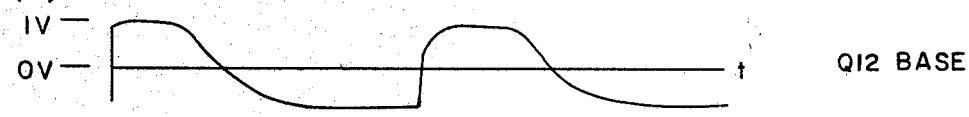
Figure 3D:
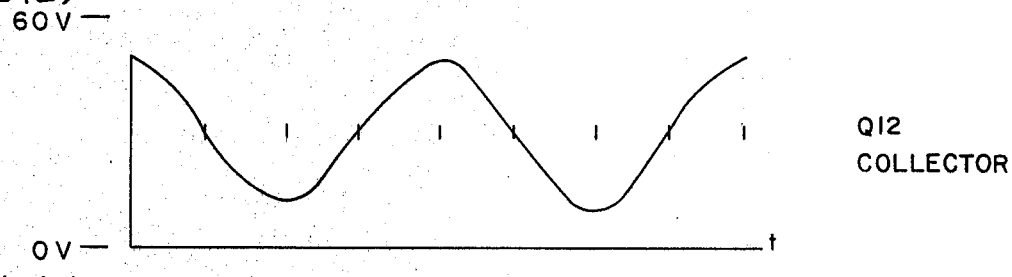
Figure 3E:
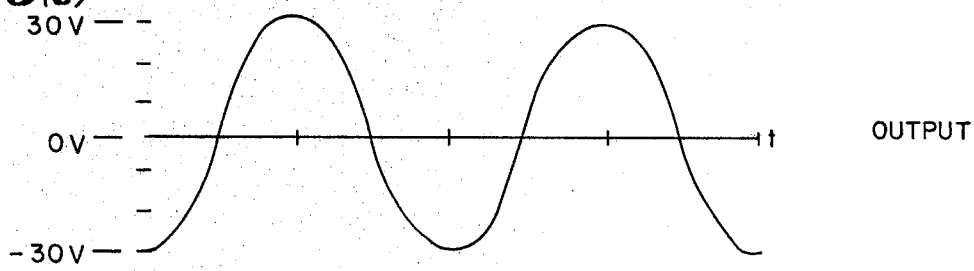

Referring now to FIGS. 2(*a*), 2(*b*) and 2(*c*) there is illustrated a circuit diagram of the circuit 10 illustrated in block form in FIG. 1. Also referring to FIGS. 3 and 4, there are illustrated, respectively, wave forms occurring at indicated positions of the circuit diagram of FIG. 2 and there is illustrated the frequency response curve of the output signal from band-pass filter 60.

Referring again to FIG. 2(*a*), low frequency oscillator 24 is connected to positive and negative battery terminals 80 and 82 respectively, which provide power to the circuit 10, the battery not being illustrated and being of any form desired.

A time constant from which the frequency modulating ramp signal of lead 26 and the mark space pedestal signal of lead 28 are generated, is provided by the network of resistor R1 and capacitor C1 through resistor R2 to the base of transistor Q1. Transistors Q1 and Q2 together with the resistors R3, R4, R5, R6, R7 and R8, and diodes D1 and D2 form an astable multivibrator. The space time of the mark space pedestal signal is determined by the time constant resulting from the network R7 and capacitor C3 when switch 16 has its wiper 22 connected to terminal post A. Continuous operation of the output signal of circuit 10 is obtained by reducing the space time of the mark space pedestal signal to approximately 150 milliseconds by switching the wiper 22 of switch 16 to terminal B. The 150 millisecond space time is determined by the network of resistor R7 and C2, capacitor C3 being switched out of the circuit.

The frequency modulation ramp signal occurs on the base of the transistor Q1 while the mark space pedestal signal occurs on the collector of transistor Q1. The frequency modulating ramp signal is fed from the base of transistor Q1 through transistor Q3 which is in an emitter follower configuration to resistor R14 (FIG. 2(*b*)) and thereafter capacitor C4. Resistor R9 provides the proper bias of transistor Q3.

Transistor Q3 also feeds the lamp driver circuit 32 through resistor R10 and transistor Q4, also in an emitter follower configuration to drive the light emitting diode 34. Resistor R11 provides the load resistance for light emitting diode 34, while resistors R12 and R13 provide the proper bias for transistor Q4.

During the space time of the mark space pedestal signal, the base and collector of transistor Q1 are both low. This low removes the charging voltage to capacitor C4 of high frequency oscillator 38 by way of resistors R14, R15, VR1 and R16 which in turn stops transistors Q5 and Q6 from oscillating.

During the mark time of the mark space pedestal signal the collector of transistor Q1 goes high providing the basic oscillating frequency for transistors Q5 and Q6 through resistors R15, VR1 and R16. During the mark time, the ramp signal from the base of transistor Q1 is applied to transistors Q5 and Q6 to provide the frequency modulation of the signal generated thereby, the frequency of the signal generated thereby being increased corresponding to the increase of the ramp signal applied thereto.

Referring now also to FIG. 2(*b*), high frequency oscillator 38 includes transistors Q5 and Q6 which together with their associate components diode D3, resistors R14, R15, R16, R17, R19 and R20 and capacitors C4, C5 and C6 form an astable multivibrator. The output frequency of oscillator 38 is determined by how fast capacitor C4 charges through resistors R14, R15, VR1 and R16. The output of oscillator 38 is from the base of transistor Q5 through DC blocking capacitor C5 with the shape of the output signal being essentially a saw tooth as is illustrated in FIG. 3(*a*).

The output of high frequency oscillator 38, which is turned on and off and which is frequency modulated is fed to burst gate 44 by way of lead 42. Burst gate 44 comprises resistors R18, VR2, R21 and R22 and transistor Q7, the resistors being arranged in a voltage divider configuration. Transistor Q7 is normally held in saturation by burst astable circuit 46, which comprises transistors Q8 and Q9 and their associated biasing and network components, resistors R23, R24, R25, R26, R27 and R28 and capacitor C7. Burst astable circuit 46 is an astable oscillator.

While transistor Q7 is held in saturation, the connection between resistors R21 and R22 is essentially grounded through transistor Q7. When transistor Q7 is switched off by astable oscillator 46, the connection between resistors R21 and R22 is ungrounded which in turn increases the signal amplitude at the wiper 84 of variable resistor VR2 approximately 8 db, providing the amplitude modulation of the signal from the high frequency oscillator 38. Operation of burst astable oscillator 46 is asynchronous to the operation of low frequency oscillator 24 and high frequency oscillator 38 so that amplitude modulation occurs randomly relative to the frequency modulation. Of course when the output of high frequency oscillator 38 is turned off, no amplitude modulation of the signal occurs.

Referring now also to FIG. 2(*c*) the composite frequency and amplitude modulated signal from burst gate 44 is provided on lead 50 to DC blocking capacitor C8 of class A driver 52. The wave form of the signal on lead 50 is illustrated in FIG. 3(*c*) as the signal on the left hand terminal of capacitor C8.

Class A driver 52 comprises Darlington arranged transistors Q10 and Q11, resistors R29, R30 and R31 and capacitors C8 and C9. Driver 52 receives an input signal modulated in amplitude and swept in frequency from 18 to 30 KHz. The output of driver 52 is from the collector of transistor Q11 through DC blocking capacitor C9 to the base of transistor Q12 in class C amplifier 54. The output signal wave form on lead 56 is illustrated in FIG. 3(*c*).

The signal on the base of transistor Q12 or on lead 56 is essentially a square wave since the voltage excursions thereof are clamped in the negative sense by diode D4 and in the positive sense by the base emitter junction of transistor Q12. The current swing at the collector of transistor Q12 is therefore switched between diode D4 and the base emitter junction of transistor Q12 with transistor Q12 being pulsed on and off or being driven in and out of conduction by transistor Q11 through capacitor C9 at the frequency of interest. The strength of the drive to the base of transistor Q12 is controlled by the amount of feedback from the collector of transistor Q12 to the emitter of transistor Q11 through feedback network 62 comprising capacitor C10 and resistors R32 and R33. The feedback circuit 62 will be described in more detail hereinafter.

The output of class C amplifier 54 is the signal appearing on the collector of transistor Q12, the wave form of which is illustrated in FIG. 3(*d*).

Figure 4:
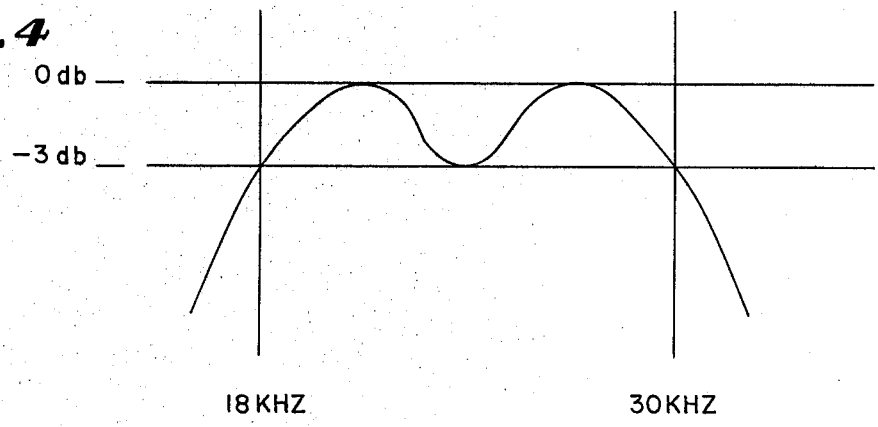
FIG. 4 is a graph of the band-pass filter response curve of the electrical signal output by the circuit illustrated in FIGS. 2(*a*)–(*c*).

Band-pass filter 60 comprises a double tuned coil T1 tuned on the primary side by capacitor C11 and on the secondary side by capacitor C12 and transducers TR1 and TR2. Because transducers TR1 and TR2 are piezoelectric speakers, they respond electrically as capacitators and are used as tuning elements for the band-pass filter 60, even though they are not shown within the dashed lines indicating band-pass filter 60. The frequency response of the band-pass filter 60 is designed to provide upper and lower −3 db points of 30 and 18 KHz respectively as is illustrated in FIG. 4. Coupling and feedback damping are set to obtain a −3 db hole at approximately 23 KHz(kilohertz). Using the technique of Q multiplication of the band-pass filter 60, there is obtained about 50 volt-amperes of circulating energy in transformer T1 and transducers TR1 and TR2 with about 20 watts DC of power input to transistor Q12.

Band-pass filter response may be adjusted to conform to the curve shown in FIG. 4 by controlling the Q of the circuit with brute force damping by supplying a resistor across the primary of coil T1(across capacitor C11). Brute force damping however requires a 20 watt resistor and doubles the required DC input to transistor Q12. The brute force method limits response of the filter essentially by absorbing power which in this particular case is represented by approximately 20 volts RMS into 50 ohms and is 8 watts.

The same band-pass filter response can be had not by using a damping resistor, but by applying negative feedback from the collector of transistor Q12 through capacitor C10 and resistor R32 to the emitter of transistor Q11. This reduces power consumption from about 33 watts to 25 watts and also eliminates the aforementioned 8 watts of wasted heat from the brute force damping resistor which otherwise must be dissipated. It is this negative feedback from the collector of transistor Q12 to the emitter of transistor Q11 which provides the −2 to −3 db hole at approximately the center of the band-pass filter response curve.

When only one transducer TR1 is being used, switch 70 which may be a circuit jack substitutes dummy load 76 which comprises a capacitor C13 for the capacitance of transistor TR2 to maintain the band-pass filter 60 properly tuned. Light emitting diode 74 is driven from the output of the band-pass filter 60 through switch 70 and capacitor C14 to visually indicate the operation of the output signal. Light emitting diode 74 carries the positive sense current passing through capacitor C14 while diode D5 carries the negative sense current passing through capacitor C14.

Concerning the frequency response curve of the band-pass filter 60 illustrated in FIG. 4, it should be noted that there are no specifications on the upper or lower skirts of the curve beyond the −3 db edges indicated at 18 and 30 KHz, and that there are no frequency or phase specifications in the band-pass region between 18 and 30 KHz.

The representative component values for one specific embodiment of the circuit are illustrated in Table 1.

TABLE 1

Unless otherwise specified, resistors are ½ Watt, 5%
Resistor values are in ohms.

RESISTORS

| | | | | | |
|---|---|---|---|---|---|
| R1 | 560K | R13 | 47K | R24 | 68K |
| R2 | 100 | R14 | 39K | R25 | 47K |
| R3 | 68K | R15 | 10K | R26 | 12K |
| R4 | 10K | R16 | 10K | R27 | 47K |
| R5 | 47K | R17 | 10K | R28 | 560K |
| R6 | 150K | R18 | 33K | R29 | 150K |
| R7 | 56K | R19 | 68K | R30 | 150K |
| R8 | 56K | R20 | 27K | **R31 | 18K |
| R9 | 10K | R21 | 68K | R32 | 82K |
| R10 | 27K | R22 | 33K | R33 | 33 |
| R11 | 270 | R23 | 47K | R34 | 33K |
| R12 | 1K | | | **2Watt | 5% |

CAPACITORS

| | | | |
|---|---|---|---|
| C1 | 47μF, 16V Tantalum | C8 | .0047μF, 100V Mylar |
| C2 | 1μF, 35V Tantalum | C9 | 0.47μF, 100V Mylar |
| C3 | 22μF, 16V Tantalum | C10 | .047μF, 100V Mylar |
| C4 | .0033μF, 100V Mylar | C11 | 0.33μF, 100V Mylar |
| C5 | .0047μF, 100V Mylar | C12 | 0.1μF, 100V Mylar |
| C6 | 220pF Ceramic | C13 | 0.1μF, 100V Mylar |
| C7 | 22μF, 16V Tantalum | C14 | .022μF, 100V Mylar |

DIODES

D1, D2, D3, D4, D5 100V Silicon Signal Diodes

TRANSISTORS

Q1, Q4, Q5, Q7, Q8, Q9, Q10, Q11 2N5172
Q2, Q3, Q6 2N6076
Q12 2N3055

MISCELLANEOUS

Switch 16, SPDT Switch Position A, Pulse; Position B, Continuous; LIGHT EMITTING DIODE 34 and 74 Light Emitting Diode
Switch 70, Miniature closed Circuit Jack
TR 1, TR 2 Motorola Piezoelectric Transducer Model KSN6001A
T 1 Band-pass Filter Double Tuned Coil
Primary & Secondary: 75 Turns #25 Wire on plastic transformer bobbin. Outside dimentions 1⅜ × 1¼ × 15/16 long. Inside dimensions ⅝ × ¾.

The component values of Table 1 provide a four second mark pedestal signal and a two second space pedestal signal.

The output of transducers TR1 and TR2 are acoustic signals or sound waves which vibrate the atmosphere they are located in at frequencies from 18 to 30 KHz and which are amplitude modulated asynchronously with the frequency modulation. In the preferred embodiment the amplitude modulation approximately doubles the power of the sound waves with the amplitude modulation having a duration of about half of a second. In the preferred embodiment the turning on and turning off of the sound waves occurs on a six second cycle, four seconds of the sound waves being on with frequency modulation and amplitude modulation occurring and then two seconds of the sound waves being turned off. The on and off times of the sound waves of course are adjustable as may be desired.

Modifications and variations of the present invention are possible in light of the above teachings. It therefore is to be understood that in the scope of the appended claims, the invention may be practiced otherwise than is specifically described.

What is claimed and desired to be secured by Letters Patent is:

1. An apparatus for producing sound waves to repel rodents, comprising:

low frequency oscillator means for producing a frequency modulating ramp signal and an alternating mark space pedestal signal;

high frequency oscillator means for producing an electrical signal oscillating within an ultrasonic frequency band which is frequency modulated through a band of frequencies between 18 and 30 kilohertz in response to the ramp signal and which is alternately turned on and turned off in response to the pedestal signal;

burst means for amplitude modulating the electrical signal by increasing the amplitude of the produced electrical signal asynchronously with the frequency modulation of the produced electrical signal;

amplifier means for amplifying the power of the amplitude modulated electrical signal including negative feedback damping means for reducing the power required for amplifying the power of the amplitude modulated signal; and transducer means for converting the amplified signal into sound waves.

2. The apparatus as claimed in claim 1 in which the burst means include an astable oscillator oscillating asynchronously to the frequency modulation of the electrical signal, and a resistor and transistor voltage divider network arranged so that one resistor portion is grounded by the transistor when the transistor is saturated and that said one resistor portion is ungrounded when the transistor is turned off, the transistor being connected to the astable oscillator and being alternately saturated and turned off by the astable oscillator to double the amplitude of the signal with the voltage divider circuit when the transistor is turned off.

3. The apparatus as claimed in claim 1 in which the amplifier means include class A driver means amplifying the amplitude modulated signal, class C amplifier means amplifying the signal from the class A driver means, tuned filter means outputting the signal from the class C amplifier means within a band of frequencies and the damping means applying a portion of the signal from the class C amplifier means to the class A driver means.

4. The apparatus as claimed in claim 3 in which the tuned filter means include a coil having a primary winding and a secondary winding, a capacitor connected across the primary winding and the transducer means being capacitive and being connected across the secondary winding to tune the filter means so that the band of pass frequencies of the filter means at the −3 db level is about from 18 to 30 kilohertz.

5. The apparatus as claimed in claim 3 in which the damping means include a resistor capacitor network.

6. A method of repelling rodents with sound waves, comprising:

generating an electrical signal oscillating within an ultrasonic frequency band;

modulating the frequency of the electrical signal by causing the electrical signal to sweep through a band of frequencies between 18 and 30 kilohertz;

modulating the electrical signal by alternating turning on and turning off the generating an electrical signal during respective first and second predetermined time periods;

modulating the amplitude of the electrical signal by increasing the amplitude of the electrical signal during a third predetermined time period asynchronously with the causing the electrical signal to sweep through a band of frequencies;

amplifying the modulated electrical signal by increasing the power of the modulated electrical signal including feedback damping the amplified electrical signal to obtain a reduced power consumption of the amplifying the modulated electrical signal; and converting the amplified electrical signal to sound waves directed towards the rodents.

7. The method as claimed in claim 6 in which modulating the amplitude of the signal includes applying the signal to a voltage divider network and alternately grounding and ungrounding a portion of the network to double the amplitude of the signal when the portion of the divider network is ungrounded.

8. The method as claimed in claim 6 in which amplifying the modulated signal includes band-pass filtering the amplified signal.

9. The method as claimed in claim 8 in which amplifying the modulated signal includes amplifying the modulated signal with a class A driver first and then a class C amplifier, negative feedback damping the amplified modulated signal by feeding a portion of the signal amplified by the class C amplifier back to the class A driver and band-pass filtering the amplified signal by applying the signal amplified by the class C amplifier to a tuned band-pass filter.

10. The method as claimed in claim 9 further including tuning the band-pass filter by connecting transducers which are capacitive to the band-pass filter.

* * * * *